US007312442B2

(12) United States Patent
Hansen

(10) Patent No.: US 7,312,442 B2
(45) Date of Patent: Dec. 25, 2007

(54) ENHANCED GRADIENT MULTIPOLE COLLISION CELL FOR HIGHER DUTY CYCLE

(75) Inventor: Stuart C. Hansen, Palo Alto, CA (US)

(73) Assignee: Agilent Technologies, Inc, Santa Clara, CA (US)

( * ) Notice: Subject to any disclaimer, the term of this patent is extended or adjusted under 35 U.S.C. 154(b) by 136 days.

(21) Appl. No.: 11/224,080

(22) Filed: Sep. 13, 2005

(65) Prior Publication Data

US 2007/0057174 A1 Mar. 15, 2007

(51) Int. Cl.
*H01J 49/42* (2006.01)

(52) U.S. Cl. ..... 250/282; 250/292; 250/288; 250/287; 250/281

(58) Field of Classification Search ..... None
See application file for complete search history.

(56) References Cited

U.S. PATENT DOCUMENTS 5,847,386 A * 12/1998 Thomson et al. ..... 250/288
6,833,544 B1 12/2004 Campbell et al.
7,166,836 B1 * 1/2007 Russ et al. ..... 250/281
2002/0092980 A1 * 7/2002 Park ..... 250/288

* cited by examiner

*Primary Examiner*—Jack I. Berman
*Assistant Examiner*—Zia R. Hashmi

(57) ABSTRACT

A method for processing ions in mass spectrometry is provided. The method provides for processing ions in a ion processing cell having elongated segmented rods, a circuit for applying RF voltages and a circuit for applying DC voltage selectively to the segments of the segmented rods. The method comprises applying an RF field to the elongated volume, applying DC voltage selectively to the segments to form a plurality of potential regions having discrete potentials; providing analyte ions to a first potential region and processing at least a portion of the analytes in the first potential region. In one embodiment, the potential region is a potential well.

21 Claims, 2 Drawing Sheets

ENHANCED GRADIENT MULTIPOLE COLLISION CELL FOR HIGHER DUTY CYCLE

TECHNICAL FIELD

The technical field relates generally to ion analysis and more particularly to ion analysis in mass spectrometry.

BACKGROUND

Mass spectrometry methods are very useful for characterizing and/or quantifying chemical entities. There are many forms of mass spectrometry and mass analyzers. For example, in time-of-flight mass spectrometry the analyser is typically a field free flight tube.

Time-of-flight mass spectrometers are based on the fundamental principal that ions which have the same initial kinetic energy but different masses will separate when allowed to drift down a field free region, e.g., the length of the flight tube in a conventional time-of-flight mass spectrometer. The ions acquire different velocities according to the mass-to-charge ratio of the ions. Accordingly, lower mass ions will arrive at a detector positioned at the end of the flight tube prior to ions of higher mass. The detector detects the ions collecting the data that yields the mass spectrum for the sample. Traditionally, the detection system is located at the end of the flight tube of a linear time-of-flight mass spectrometer opposite the end of the flight tube where the ions are generated.

Because the ions of different mass-to-charge ratios arrive at the detector at different times, continual emission of ions from the ion source into the flight tube is problematic as ions with lower masses may over take slower moving higher mass ions emitted earlier. Accordingly, in the conventional time-of-flight mass spectrometer, it is necessary to allow all ions emitted at a given time to reach the detector before emitting more ions for analysis.

Conventionally, the sample that passes into the flight tube is not a continual beam of ions. Usually the ion beam is divided into packets of ions at the ion source. The ion packets are launched from the ion source at one end of the flight tube into the flight tube using a pulse and wait approach. When using the traditional pulse and wait approach, the release of an ion packet from the source is timed to ensure that the lower mass faster ions of a trailing packet do not pass the higher mass and slower ions of a preceding packet and that the ions of the preceding packet reach the detector before any overlap can occur. Accordingly, the period between release of packets is relatively long as compared to the amount of time for the release. This creates a low duty cycle. As ion sources typically generate ions from a sample continuously in the ion source, only a small portion of the ions generated in the ion source are emitted from the source as ion packets and undergo detection. Thus a significant amount of sample material is wasted and sensitivity is reduced.

The inefficient capture of analyte ions for analyses may be particularly problematic if the analyte ions are subjected to tandem mass spectrometry methods prior to introduction into the time-of-flight analyzer.

In U.S. Pat. No. 6,833,544, Campbell et al. disclose use of a linear ion trap component in a mass spectrometer system for collision induced dissociation. Campbell disclosures use of segmented rods to form a gradient to move ions through a collision cell.

However, the need remains for improved apparatus and methods for processing ions in time-of-flight mass spectrometry.

SUMMARY

A method of processing ions in an ion processing cell having a set of elongated-segmented rods with each rod having a plurality of segments defining an elongated volume having a longitudinal axis; a circuit for applying RF voltage to the elongated-segmented rods to provide an RF field in the volume, and a circuit for applying a DC voltage to the segments wherein different DC voltages can be applied to different segments and the DC voltage to a given segment can be selectively changed.

The method comprises applying an RF field to the elongated volume and DC voltages to the segments of the elongated segmented rods. Different DC voltages are selectively applied to the segments thereby forming a DC field in the volume having a plurality of regions of discrete potentials.

Analyte ions are provided to at least one potential regions in the elongated volume and at least a portion of the analyte ions are processed in the at least one potential region.

One or more of the potential regions may comprise a potential well.

DETAILED DESCRIPTION OF THE DRAWINGS

DETAILED DESCRIPTION

Figure 1:
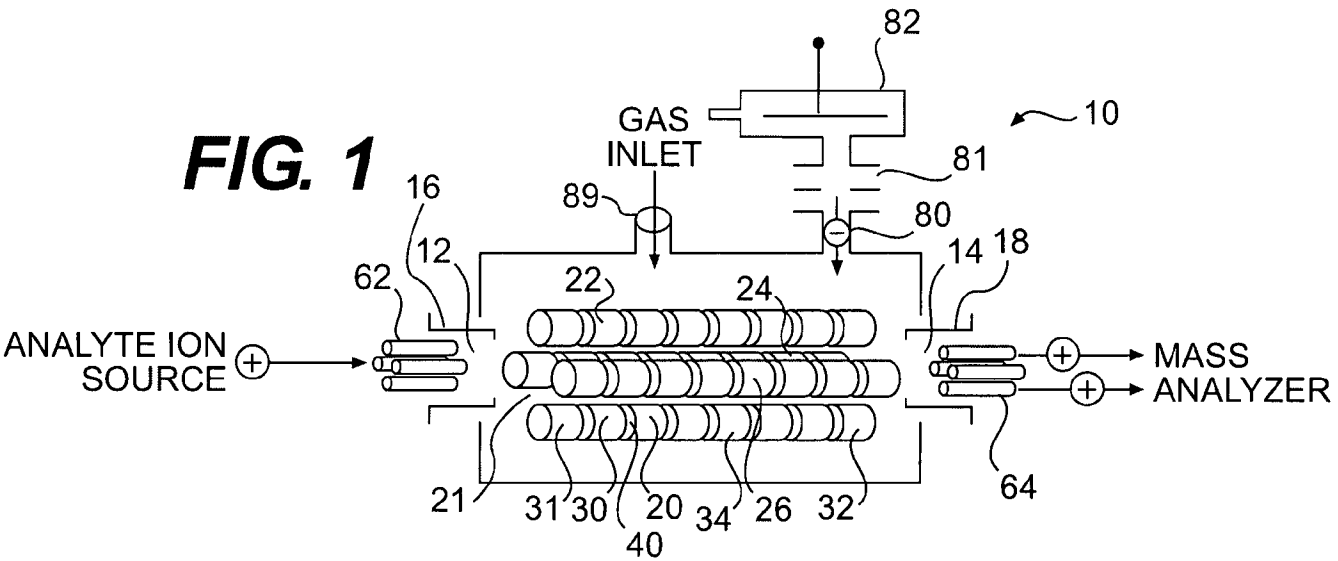
FIG. 1 is a perspective view of an ion processing cell.

The method described herein provides for processing of ions in mass spectrometry. More particularly the method utilizes an apparatus that provides for processing ions in discrete regions within a field in an ion processing cell prior to releasing the ions from the processing cell to a mass analyzer. Optionally, in addition to trapping or collecting the ions, processing may include reacting and/or fragmenting the ions in a discrete region of the processing cell prior to release into the analyzer. The processing cell may comprise a single discrete region containing ions, a plurality of discrete regions containing ions, discrete regions containing no ions, or a combination thereof.

The processing cell comprises segmented rods and a means for admitting reactive reagent ions to the processing cell. The segmented rods may be configured as a quadrupole, hexapole or other multipole structure. The processing cell receives analyte ions from an ion source. Processing of the ions may include trapping and collecting ions, subjecting analyte ions to collisional activation, ion-ion reactions, ion-molecule reactions, electron transfer dissociation, alternating gradient fragmentation, charge reduction, proton transfer reactions, electron transfer reactions, photodissociation, ion selection, ion transfer or a combination thereof, and the like. After processing, the processed ions may be transferred to any mass analyzer. However, the processing cell is particularly well suited for use with time-of-flight mass analyzers.

Typically, the processing cell is used in a mass spectrometer system that comprises an analyte ion source, processing cell and a mass analyzer. Analyte ions are formed in the analyte ion source. For example, analyte ions may be generated in the analyte ion source by electron impact, chemical ionization, MALDI (Matrix Assisted Laser Desorption Ionization), electrospray, fast atom bombardment, and the like. The thus formed analyte ions may be passed directly to the processing cell. Optionally, the system may further comprise a mass filter that transmits only selected ions to the processing cell.

Analyte ions are admitted to the ion processing cell and more particularly to the elongated volume in the ion processing cell defined by the set of segmented rods that comprise the multipole. An RF voltage is applied to all rods to provide an RF field in the elongated region between the rods, and DC voltages are selectively and controllably applied to the segments, thus providing for the trapping of ions in discrete regions and controlling movement and transfer of ions. Reagent may be admitted to the ion processing cell and reacted with at least a portion of the analyte ions. The reagent may be a reactive reagent that reacts with the analyte ions; an inert gas which collides with the analyte ions causing energy absorption or, depending on the energy of collision, fragmentation; or electrons, protons, or photons that interact with the analyte ions. Processing includes manipulation of the DC and/or RF voltage in a timed sequence to modify the field or a portion of the field in the processing cell to create potential regions. Typically, the potential regions are one or more potential wells for trapping ions. The DC voltages may be manipulated to create a plurality of potential wells at a given point in time. Optionally, a DC and/or RF voltage may be manipulated to form and move the well or wells to provide conditions that facilitate the reaction between the analyte ions and a reagent and/or provide for one or more additional processing steps and/or facilitate transfer of ions from the cell. Optionally, an auxiliary AC voltage may be applied and adjusted to cause fragmentation or selective ejection of ions. After processing in the ion processing cell, the processed ions are transferred to a mass analyzer for analysis and obtaining a mass spectrum or other data collection. Mass analyzers may include time of flight mass analyzers, quadrupole mass analyzers, momentum mass analyzers, and the like.

FIG. 1 shows a schematic perspective view of an exemplary embodiment of an ion processing cell 10 in which ions may be trapped in discrete regions. The cell has entrance orifice 12 and exit orifice 14 for admitting ions into the ion processing cell 10 and transferring them from the ion processing cell 10, respectively.

FIG. 1 shows a quadrupole embodiment of the ion processing cell. As shown in FIG. 1, the ion processing cell 10 has four segmented rods 20, 22, 24, 26. The rods 20, 22, 24, 26 are positioned around an elongated trapping volume 21. Each segmented rod 20, 22, 24, 26 is divided into a plurality of segments 30. Typically, all the segmented rods are segmented in a similar manner. For example, in one exemplary embodiment, four segmented rods each 15 cm long by 12.5 mm diameter and each divided into twelve similar segments are used. This example is exemplary and other sizes of rods and/or number of segments may be similarly suitable. The segments 30 are separated by gaps 40. In an exemplary embodiment, 10 mm segments 30 with 0.3 mm gaps 40 are used. The segments 30 may be discrete sections made of a conducting material or a substrate coated with a conducting material and aligned using a support. Some embodiments use segmented rods 30 formed by coating a non-conducting rod with a conducting material at discrete positions interposed between uncoated areas of the non-conducting rod. For example, each rod may be formed by applying a metalized layer onto a rod formed from an insulating material such as a ceramic, for example, then removing portions of the metal coating. To remove a portion of the metal coating, a band may be cut in the metal around the circumference of the rod and the cut band of metal removed from around the circumference. Removal of the cut band of metal forms the gap 40. The process is repeated to form multiple segments. Segmented rods 30 should be taken to mean either discrete individual segments, a rod selectively coated with a conducting material to give regions of metal coated rod interposed between uncoated areas of nonconducting material, or a combination thereof.

Figure 2:
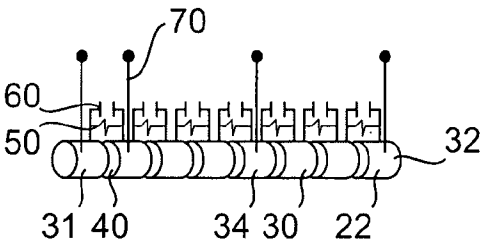
FIG. 2 is a schematic diagram of a segmented rod.

FIG. 2 shows an exemplary segmented rod 22. As shown in FIG. 2, each gap 40 is bridged by a chip resistor 50 and a capacitor 60 to provide a means for providing a constant RF voltage and optional DC gradient to each of the segments 30. Optionally, circuitry (not shown) for an auxiliary AC excitation voltage to at least a portion of the segments 30 may be provided. A plurality of segments 30 have electrical leads 70 for controlling the DC voltage to the particular segment 30 connected to the lead 70. The leads 70 are brought outside the ion processing cell 10 and any structures surrounding the ion processing cell which are operated at a reduced pressure (e.g. the vacuum chamber) for connection to the driver electronics which may be controlled manually or by an automated system. In one embodiment, the plurality of leads 70 includes leads to a sufficient number of segments 30 to create a trapping field inside the ion processing cell. For the exemplary rod 22 of FIG. 2, leads 70 include leads 70 to end segments 31, 32 and an intermediary segment 34 of rod 22. The position of intermediary segment 34 shown in FIG. 2 is exemplary and any of the segments between end segments 31 and 32 may be selected as an intermediary segment 34. Typically, end segments 31, 32 are located at the terminus of the segmented rod 22. It is not required that end segments 31, 32 are the terminal segments 30 and any two segments 30 connected to leads 70 and having at least one segment 30 interposed therebetween may serve as end segments 31, 32. Leads 70 would be connected similarly to all of the other segmented rods 20, 24, 26 including selecting end segments 31, 32 and the intermediary segment 34 to be in the same relative position on each segmented 20, 22, 24, 26 for the quadrupole embodiment shown.

In some embodiments, individual leads 70 may be attached to additional segments 30 or in other embodiments to all segments 30. The connection of leads 70 to segments 30 provides for direct control of the DC voltage and/or control of the potential field associated with the segment 30 so connected. Increasing the number of segments 30 attached to leads 70 provides for highly selective control of the field in the elongated volume 21. Such control may include establishing and/or modifying a potential well or a plurality of potential wells and/or transferring ions to and from a potential well within the elongated volume 21.

Alternatively, the means for trapping ions in the processing cell 10 may be a pair of ion gates. Returning to FIG. 1, ion shields or, alternatively, multipoles may be employed as ion gates. For example, a pair of shields 16, 18 near entrance orifice 12 and exit orifice 14, respectively, may be employed as ion gates. Alternatively, multipoles 62, 64 positioned near the entrance orifice 12 and exit orifice 14, respectively, may be used as ion gates. Likewise, some combination of shields, and/or multipoles and/or segments may be employed to form gates for trapping ions. Any of the shields, multipoles and segments may perform functions other than acting as an ion gate. Accordingly, one or more of these structures may be present in some embodiments without acting as an ion gate and perform a function other than acting as an ion gate.

Referring to FIG. 1, reagent may be admitted to the ion processing cell 10 through reagent orifice 80. The reagent may be a reactive reagent including ions, protons, electrons or photons, or an inert reagent gas that induces collision activation of the analyte ions. FIG. 1 shows a single reactive reagent orifice 80. A plurality of reactive reagent orifices 80 may be used in some embodiments. The position of the orifice 80 may provide for an enhanced density of reagent in a particular region of the ion processing cell 10. Optionally, a lens 81 or lenses may be provided at or near the reagent orifice 80 to focus charged reagent species as they are admitted to the ion processing cell 10.

The voltages can be manipulated to a group of segments and/or individual segments in a timed sequence. As multiple leads 70 are used, the voltages to selected segments 30 may be controlled and changed to create different configurations of the potential region or region in the elongated volume 21. Namely, the number of regions, size of region, or nature of region may be changed and/or field potential to particular regions manipulated. The circuitry provides for a making such changes in a timed sequence. Thus, ions can be trapped in a potential region or well in the elongated volume 21 and optionally be subjected to a sequence of potential field conditions in the ion processing cell 10 and/or selectively moved through the processing cell 10 prior to being passed to the mass analyzer. Selective movement of a well through the ion processing cell 10 creates a traveling well.

The trapping and movement of ions can be controlled to provide for selectively moving ions through the ion processing cell 10 and/or providing for additional processing steps for ions collected in a potential region. A plurality of potential wells and/or discrete processing regions or combination thereof may exist in the processing cell 10 at the same time and one or more of the processing regions may contain trapped ions. Trapped ions are ions selectively confined in a discrete region of the processing cell.

In an exemplary embodiment, interposing the ion processing cell 10 between an analyte ion source and a time-of-flight mass analyzer provides for collecting ions generated between ion pulses in a time-of-flight analyzer and storing the collected ions prior to release of the collected ions into the analyzer in a subsequent pulse. Collection and storage permits analysis of a larger portion of analyte ions generated by the analyte ion source in the time-of-flight system. In some embodiments, it may be possible to collect, store and analyze most of the ions formed in the analyte ion source. Collection and storage of ions can increase the duty cycle of the time-of-flight instrument.

Ions are typically collected in the ion processing cell 10 in the presence of an inert gas to slow the ions and facilitate collection. The gas pressure should be sufficient to slow ions but not so high as to induce fragmentation of the ions. Gas pressures of 1 to 20 mTorr are typically sufficient. The optimum pressure depends on the ions to be analyzed and the type of inert gas used. For many applications, a pressure of 5 to 10 mTorr is used and use of 5 mTorr is common.

An exemplary schematic sequence for processing analyte ions is shown in FIGS. 3A-3F. For the sequence diagramed in FIGS. 3A-3F, an inert gas is used in the ion processing cell 10 throughout the sequence. The inert gas is typically at 5 mTorr and, unless otherwise indicated, causes ions to lose energy during residence in the ion processing cell 10 by non-fragmenting collisions. The changes shown in the schematic sequence are accomplished by modifying the DC and RF voltages. Optionally, the modification of the DC and RF voltages may be done in a timed sequence. For the schematic sequence of FIGS. 3A-3F, the vertical axis depicts field potential in the ion processing cell 10 with potential increasing along the vertical axis in the direction away from the horizontal axis. The horizontal axis represents the longitudinal axis of the ion processing cell 10. Accordingly, a position on the horizontal axis corresponds to a position in the ion processing cell 10. For purposes of explanation, assume in FIG. 3A-3F that analyte ions move in the general direction of left to right in passing through the ion processing cell 10 and into an analyzer. However, in actual practice analyte ions could be moved generally either left or right and analyte ions may have a variety of motions as they pass through the ion processing cell 10.

Figure 3A:
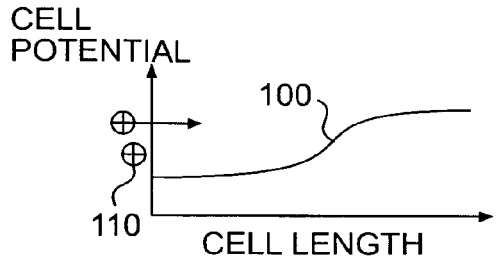
FIG. 3 is an exemplary schematic sequence for processing ions in the processing cell.

As shown in the scheme FIG. 3A, the field potential 100 is sufficiently low near the entrance 12 of the ion processing cell 10 to admit ions 110 into the ion processing cell 10 and sufficiently high near the exit 14 of the processing cell 10 to prohibit ions from exiting the ion processing cell 10.

Figure 3B:
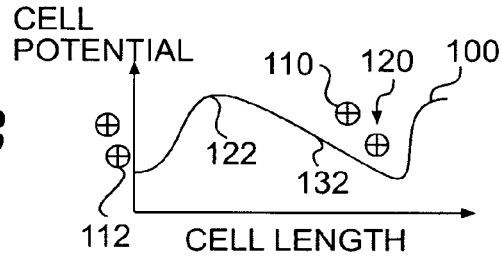

As the scheme FIG. 3B shows, once a first group of ions 110 are admitted to the ion processing cell 10, the field potential 100 is raised near the ion processing cell entrance 12 to trap the first group of ions 110 in potential region 120 in the cell. The potential on either side of potential region 120 is such that the first group of ions 110 can not exit potential region 120 and a second group of ions 112 can not enter the potential region 120 (e.g. energy barriers are formed on either side of potential region 120). Energy barrier 122 at the edge of potential region 120 nearest the ion processing cell entrance 12 may be positioned to align with the ion processing cell entrance 12. When the energy barrier 122 is positioned to align with the ion processing cell entrance 12, the second group of ions 112 is prohibited from entering the ion processing cell 10. Alternatively, as shown in the scheme FIG. 3D, the energy barrier 122 may be positioned along the ion processing cell 10 axis to allow a second group of ions 112 to enter the ion processing cell 10 in a discrete region and prohibit the second group of ion 112 from mixing with the first group of ions 110. A gradient 132 may be applied in potential region 120 to direct the ions 110 to a specific position within potential region 120.

Figure 3C:
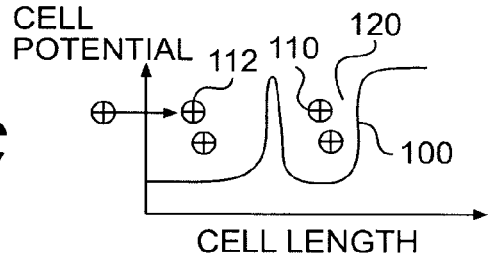

In the scheme FIG. 3C, the potential region 120 of the ion processing cell 10 has been further changed such that potential region 120 is a potential well and the first group of ions 110 are trapped in the potential well. Once trapped in the potential well, ions 110 may be moved to the mass analyser as a packet while a second group of ions 112 is collected in the ion processing cell 10. In one embodiment, processing ions comprises trapping ions 110 in a potential region 120 (or potential well) in the ion processing cell 10 and moving ions 110 to an analyzer while collecting a second packet of ions 112 in another portion of the ion processing cell 10. In such embodiments, packets of ions can be transferred to a mass analyzer and collection of packets of ions for delivery to the analyzer can be nearly continual. This embodiment is particular useful for enhancing the duty cycle of a time-of-flight analyzer.

In some embodiments processing may further comprise reacting ions 110 with reactive reagent in the potential region 120. Reactive reagents may include reactive reagent ions, protons, electrons or photons. The reactions may include inducing ion-ion or ion-molecule reactions, including chemical reactions and charge transfer reactions, fragmentation or combination thereof and the like. In some embodiments an auxiliary AC voltage may be applied to at least a portion of the segments 30 to excite the ions 110 in potential region 120. Once excited, the ions may then collide with the inert gas and undergo collisionally induced dissociation. Optionally, multiple types of processing can be performed on ions 110 and/or collected products derived from ions 110. Also optionally, a given type of processing can be repeated on ions 110 or products collected from ions 110.

Figure 3D:
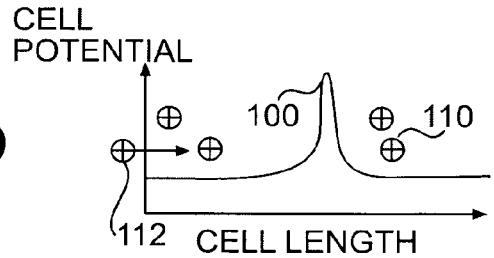
Figure 3E:
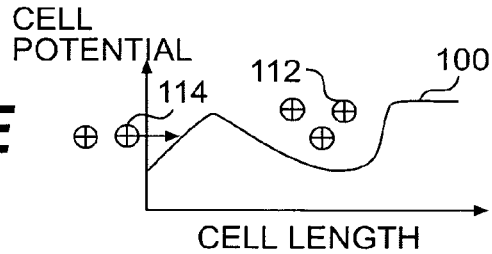
Figure 3F:
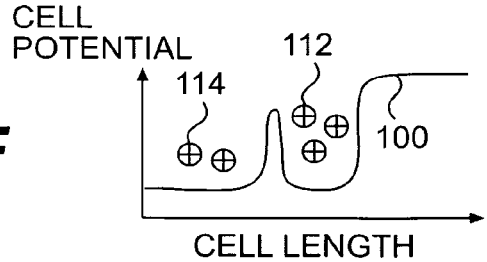

In the scheme FIG. 3D, the field potential 100 is lowered near the ion processing cell exit 14 eliminating one side of the energy barrier around potential region 120. Namely, one of one energy barriers that forms the potential well is eliminated and ions 110 are allowed to exit the ion processing cell 10 to the mass analyzer. A second group of ions 112 may be collected throughout time that ions 110 are trapped in the potential region 120 (well) and moved through the ion processing cell 10. Optionally, ions 112 may undergo additional processing including processing similar to that for ions 110 or a different type of processing. Typically, additional processing steps such as collisional activation or reaction with reactive reagent ions is done when ions 110, 112 are trapped in their respective potential regions 120 or wells but this is not required. Alternatively, for example, ions could be subjected to collision activation or reactions as they are collected prior to being trapped in the energy well, for example. The schemes FIGS. 3E and 3F show the second group of ions 112 being trapped in an potential well in the ion processing cell 10 and a third group of ions 114 being collected in a discrete region of the ion processing cell 10 separate from the second group of ions 112.

Figure 4:
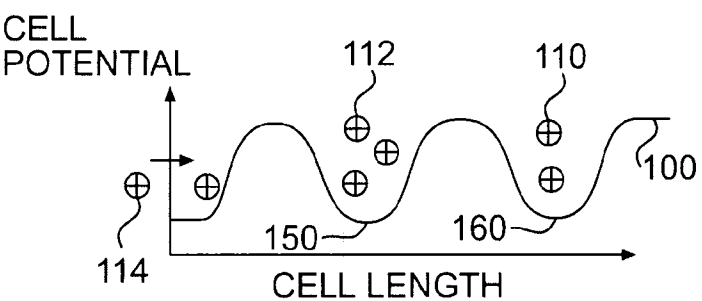
FIG. 4 is an exemplary schematic sequence for processing ions in a processing cell having a plurality of potential wells.

FIG. 4 shows an embodiment with a plurality of potential wells 150, 160 in the ion processing cell 10 simultaneously. Two wells 150, 160 are shown in FIG. 4, but this embodiment is exemplary and the plurality of wells may include two or more potential wells. As discussed above, each well can trap a discrete group of ions and move the ions through the cell as a discrete group or packet. The wells 150, 160 may facilitate collection and act as traveling wells to transfer of ions to improve duty cycle and/or facilitate additional processing. Additional ion processing steps in the wells 150, 160 may occur sequentially or simultaneously.

In addition to trapping, collecting ions, and transferring ions additional processing steps may include subjecting the analyte ions to one or more reactions such as ion-ion reactions, ion-molecule reactions, electron transfer dissociation, alternating gradient dissociation, charge reduction, proton transfer reactions, electron transfer reactions, photodissociation, and the like and/or subjecting the ions to collisional activation or a combination thereof, for example. Selection of the processing step or steps to use is determined by the information sought, and the chemical and physical properties of the analyte ions and reactive reagent used. Optimization of the experimental design and parameters is typically determined experimentally.

Multiple processing steps may include collisional activation of a packet of ions, selected ions from a packet of ions or a product or fragment ion formed from a packet of ions in a previous processing step. Collisional activation is usually performed by the activation and collision of the selected ions with an inert gas. Activation may be accomplished by applying an auxiliary AC voltage to at least a portion of the segments 30. The selected ions thus gain sufficient energy to fragment when collided with the inert gas present in the ion processing cell 10. Typically, an inert gas such as argon or krypton is used as the collision gas. A pressure of 5 mTorr and collision of energy of 20-40 eV is exemplary of a typical parameter for collisional activation.

In some analyses the range of ions generated in the analyte ion source is processed and analyzed and in other analyses ions having certain m/z values are of interest. Whether ions having a range of m/z values or ions having a specific selected m/z value are desired for analysis depends on the nature of the sample investigated and the information sought. Ions formed in the analyte ion source may be admitted to the ion processing cell 10 without prior mass selection. Alternatively, a mass filter may be used to preselect a mass or range of masses of ions to be admitted to the ion processing cell 10. Alternatively, ions may be selected in the ion processing cell by ejecting ions having m/z values different from the m/z of the ions of interest from the ion processing cell 10.

The foregoing discussion discloses and describes many exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

The invention claimed is:

1. A method for processing ions in an ion processing cell having a set of elongated-segmented rods defining an elongated volume therebetween, a circuit for applying a RF voltage to the elongated-segmented rods to provide a RF field in the volume, and a circuit for applying DC voltages to the segments wherein different DC voltage can be applied to different segments and the DC voltage to a given segment can be selectively changed, the method comprising:

applying an RF field to the elongated volume;

applying DC voltages to the segments of the elongated segmented rods wherein different DC voltages are selectively applied to the segments thereby forming a plurality of potential regions having discrete potentials in the elongated volume;

providing analyte ions in a first potential region of the plurality of potential regions; and processing at least a portion of the analyte ions in the first potential region.

2. The method of claim 1, further comprising controlling the DC and RF voltages in a timed sequence.

3. The method of claim 1, further comprising processing analyte ions by trapping the analyte ions in the first potential region.

4. The method claim 1, further comprising processing analyte ions by combining the analyte ions in the first potential region with a reactive reagent.

5. The method of claim 1, further comprising collecting a first portion of analyte ions in the first potential region of the plurality of regions and a second portion of the analyte ions in a second potential region of the plurality of potential regions sequentially.

6. The method of claim 5, further comprising subjecting the collected first and second portions of analyte ions to a second processing step, wherein the first and the second portions of analyte ions are processed in the first and the second potential regions sequentially.

7. The method of claim 5, further comprising subjecting the collected first and second portion of analyte ions to a second processing step wherein the first and the second portions of analyte ions are processed in the first and the second potential regions simultaneously.

8. The method of claim 5, further comprising subjecting the collected first portion of analyte ions in the first potential region and the collected second portion of analyte ions in the second potential region to a second processing step wherein the second processing step is the same second processing step for the first and second portions of analyte ions.

9. The method of claim 5, further comprising subjecting the collected first portion of analyte ions in the first potential region and the collected second portion of analyte ions in the second potential region to a second processing step wherein the second processing step is a different second processing step for the first and second portions of analyte ions.

10. The method of claim 1, wherein the first potential region is a potential well.

11. The method of claim 1, further comprising applying an auxiliary AC voltage to at least a portion of the segments of the segmented rods.

12. The method of claim 11, wherein processing the analyte ions comprises mixing the analyte ions with an inert gas and applying the auxiliary AC voltage to excite the analyte ions and induce collisional dissociation.

13. The method of claim 1, wherein the plurality of regions include a plurality of regions that are potential wells.

14. The method of claim 1, further comprising transferring processed ions to a mass analyzer and obtaining a mass spectrum of the processed ions.

15. A method of processing ions in an ion processing cell having a set of elongated-segmented rods defining an elongated volume therebetween, a circuit for applying a RF voltage to the elongated-segmented rods to provide a RF field in the volume, and a circuit for applying DC voltages to the segments wherein different DC voltage can be applied to different segments and the DC voltage to a given segment can be selectively changed, the method comprising:

providing ions in the elongated volume;

applying an RF field to the volume;

applying DC voltages to the segments of the elongated segmented rods wherein different DC voltages are selectively applied to the segments thereby forming a discrete potential well in the volume; and processing a portion of the ions in the potential well.

16. The method of claim 15, further comprising processing the ions by trapping the analyte ions in the potential well.

17. The method of claim 15, further comprising processing the ions in the potential well by combining the ions with a reactive reagent.

18. The method of claim 15, further comprising selectively applying DC voltages to the segments of the elongated segmented rods to form the potential well in a first region of the elongated volume and a second potential well in a second region of the elongated volume.

19. The method of claim 18, wherein ions are processed in the potential well and the second region in the elongated volume sequentially.

20. The method of claim 18, wherein ions are processed in the potential well and the second region in the elongated volume simultaneously.

21. The method of claim 15, further comprising providing a circuit for applying an auxiliary AC voltage;

mixing the ions with an inert gas, and applying an auxiliary AC voltage sufficient to excite the ions and induce collisional dissociation.

* * * * *